US009513086B2

(12) United States Patent
Wenn et al.

(10) Patent No.: US 9,513,086 B2
(45) Date of Patent: Dec. 6, 2016

(54) BORESIGHT INSERT FOR ALIGNMENT OF AIMING SYSTEM WITH FIRING SYSTEM OF WEAPON

(71) Applicant: Raytheon Company, Waltham, MA (US)

(72) Inventors: Chad Wenn, Tucson, AZ (US); Anthony R. Vulcano, Vail, AZ (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 14/622,522

(22) Filed: Feb. 13, 2015

(65) Prior Publication Data

US 2016/0238345 A1 Aug. 18, 2016

(51) Int. Cl.

| | |
|---|---|
| ***F41G 1/00*** | (2006.01) |
| ***F41G 3/32*** | (2006.01) |
| ***F41G 1/54*** | (2006.01) |

(52) U.S. Cl.

CPC ..... *F41G 3/323* (2013.01); *F41G 1/54* (2013.01)

(58) Field of Classification Search

CPC ..... F41G 1/54; F41G 1/545; F41G 3/323; F41A 33/02; F41A 31/02

USPC ..... 42/115, 116, 121, 134, 70.11; 89/41.17

See application file for complete search history.

(56) References Cited

U.S. PATENT DOCUMENTS 2,819,527 A * 1/1958 Spurling ..... F41G 1/54 359/428
4,090,305 A * 5/1978 Cassidy ..... F41G 1/54 33/391
4,459,757 A * 7/1984 Lippuner ..... F41G 1/54 33/286
4,530,162 A 7/1985 Forrest et al.
4,534,116 A * 8/1985 Davis ..... F41G 1/54 279/2.03
4,825,258 A * 4/1989 Whitson ..... F41G 1/54 33/286
5,204,483 A * 4/1993 Tellechea ..... F41A 29/02 42/90
5,365,669 A * 11/1994 Rustick ..... G01B 5/0023 33/DIG. 21
5,396,708 A * 3/1995 Whitley ..... F41G 3/323 279/2.02

(Continued)

FOREIGN PATENT DOCUMENTS

WO WO 2008/104008 A1 8/2008
WO WO 2012/005826 A2 1/2012

OTHER PUBLICATIONS

Notification of Transmittal of the International Search Report and the Written Opinion of the International Searching Authority dated Mar. 17, 2016 in connection with International Patent Application No. PCT/US2015/065336, 12 pages.

*Primary Examiner* — Michael David

(57) ABSTRACT

A system includes a boresight insert configured to be partially inserted into a barrel of a weapon. The boresight insert includes an optics section configured to generate light that identifies an impact point for a projectile from the weapon. The boresight insert includes a mechanical section coupled to the optics section. The mechanical section is configured to engage an inner surface of the barrel to secure the boresight insert in place and to disengage the inner surface of the barrel to allow insertion and removal of the boresight insert.

20 Claims, 6 Drawing Sheets

(56) References Cited

U.S. PATENT DOCUMENTS 5,432,598 A * 7/1995 Szatkowski ..... F41G 1/545 356/153
5,446,535 A * 8/1995 Williams ..... F41G 3/323 33/286
5,448,834 A * 9/1995 Huang ..... F41G 1/545 279/2.12
5,454,168 A * 10/1995 Langner ..... F41G 3/323 356/153
5,486,913 A * 1/1996 Aharon ..... F41G 1/545 356/153
5,618,099 A * 4/1997 Brubacher ..... F41G 1/545 362/111
6,289,624 B1 * 9/2001 Hughes ..... F41G 1/545 42/116
6,295,753 B1 * 10/2001 Thummel ..... F41A 33/02 42/116
6,397,509 B1 * 6/2002 Langner ..... F41G 1/54 42/111
6,499,247 B1 * 12/2002 Peterson ..... F41G 1/54 42/116
6,622,414 B1 * 9/2003 Oliver ..... F41A 33/02 42/116
7,155,834 B2 * 1/2007 Palumbo, III ..... G01C 15/002 33/227
7,377,556 B2 * 5/2008 Ho ..... F16L 19/07 285/338
7,665,218 B1 * 2/2010 Pinto ..... F41G 3/323 33/282
7,856,729 B1 12/2010 Pinto et al.
7,900,391 B1 * 3/2011 Mihelish ..... F41A 31/02 42/116
8,006,427 B2 8/2011 Blevins et al.
8,132,354 B1 * 3/2012 Sellers ..... F41G 1/54 42/116
8,510,981 B1 * 8/2013 Ganther ..... F41G 1/545 42/121
8,661,725 B1 * 3/2014 Ganther ..... F41G 1/545 42/119
8,695,266 B2 * 4/2014 Moore ..... F41G 1/44 356/249
8,739,677 B1 * 6/2014 Robbins ..... F41G 1/545 42/121
9,170,079 B2 * 10/2015 Moore ..... F42B 8/02
2006/0265929 A1 * 11/2006 Haney ..... F41G 3/2655 42/116

* cited by examiner

BORESIGHT INSERT FOR ALIGNMENT OF AIMING SYSTEM WITH FIRING SYSTEM OF WEAPON

TECHNICAL FIELD

This disclosure is generally directed to boresight alignment of a weapon. More specifically, this disclosure is directed to a boresight insert for alignment of an aiming system with a firing system of a weapon.

BACKGROUND

A weapon that fires projectiles typically includes (i) a firing system having a barrel through which the projectiles are fired and (ii) an aiming system used to aim the weapon. The aiming system often includes a sight through which a user can observe the direction that the barrel is pointing or see the point at which the barrel's muzzle is aimed. The sight of the weapon may sometimes include a scope with crosshairs.

Boresighting refers to the process of calibrating an aiming system, such as by calibrating the sight of a weapon so that the crosshairs of the scope align with a spot where the barrel muzzle is pointing. In some conventional approaches, a user can install a boresighter device into the discharge end of the barrel. The boresighter emits a laser beam that identifies where a projectile would hit if fired through the muzzle, and the user can adjust the sight until the crosshairs mark the same spot.

Unfortunately, the boresighting process for in-field weapon systems often requires heavy and cumbersome equipment, and multiple people are typically needed to carry the equipment. Also, the equipment often requires considerable time to install, use, orient, calibrate, and tear down in the field. In addition, equipment installation is often complex because the equipment typically includes mechanical, electrical, and optical components requiring setup.

SUMMARY

This disclosure provides a boresight insert for alignment of an aiming system with a firing system of a weapon.

In a first embodiment, a system includes a boresight insert configured to be partially inserted into a barrel of a weapon. The boresight insert includes an optics section configured to generate light that identifies an impact point for a projectile from the weapon. The boresight insert includes a mechanical section coupled to the optics section. The mechanical section is configured to engage an inner surface of the barrel to secure the boresight insert in place and to disengage the inner surface of the barrel to allow insertion and removal of the boresight insert.

In a second embodiment, an apparatus includes a mechanical coupler configured to be inserted into a barrel of a weapon. The mechanical coupler is also configured to be coupled to optics that generate light to identify an impact point for a projectile from the weapon. The mechanical coupler comprises first, second, and third shells. The first shell is configured to be coupled to the optics. The second shell is disposed between the first shell and the third shell. The third shell is configured to be moved towards the first shell in order to cause the engagement device to engage the inner surface of the barrel. The mechanical coupler also includes multiple wedges positioned between angled surfaces of the shells.

In a third embodiment, a method includes partially inserting a boresight insert into a barrel of a weapon. The method includes engaging the boresight insert to secure the boresight insert in the barrel. The method includes generating light using the boresight insert to identify an impact point for a projectile from the weapon. The method includes disgaging the boresight insert to remove the boresight insert from the barrel. The boresight insert comprises first, second, and third shells. The second shell is disposed between the first shell and the third shell. The third shell is configured to be moved towards the first shell in order to cause the engagement device to engage the inner surface of the barrel. The boresight insert also comprises multiple wedges positioned between angled surfaces of the shells.

Other technical features may be readily apparent to one skilled in the art from the following figures, descriptions, and claims.

BRIEF DESCRIPTION OF THE DRAWINGS

For a more complete understanding of this disclosure, reference is now made to the following description, taken in conjunction with the accompanying drawings, in which.

DETAILED DESCRIPTION

FIGS. 1 through 10, discussed below, and the various embodiments used to describe the principles of the present invention in this patent document are by way of illustration only and should not be construed in any way to limit the scope of the invention. Those skilled in the art will understand that the principles of the invention may be implemented in any type of suitably arranged device or system.

Figure 1:
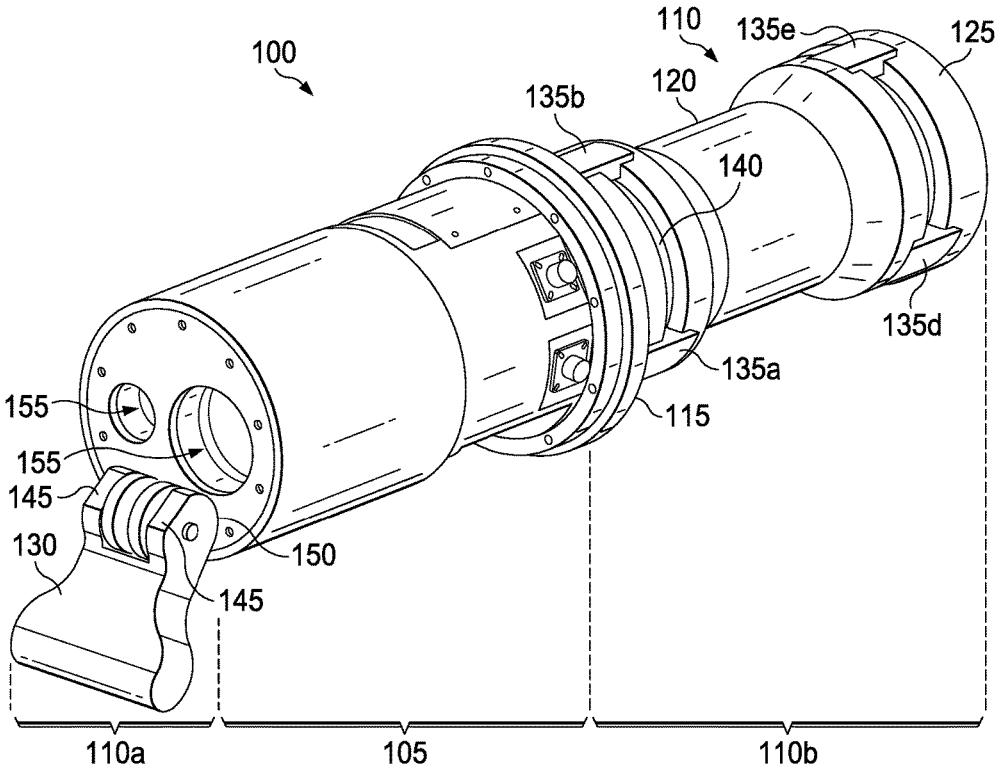
FIGS. 1 through 3 illustrate an example boresight insert according to this disclosure.
Figure 2:
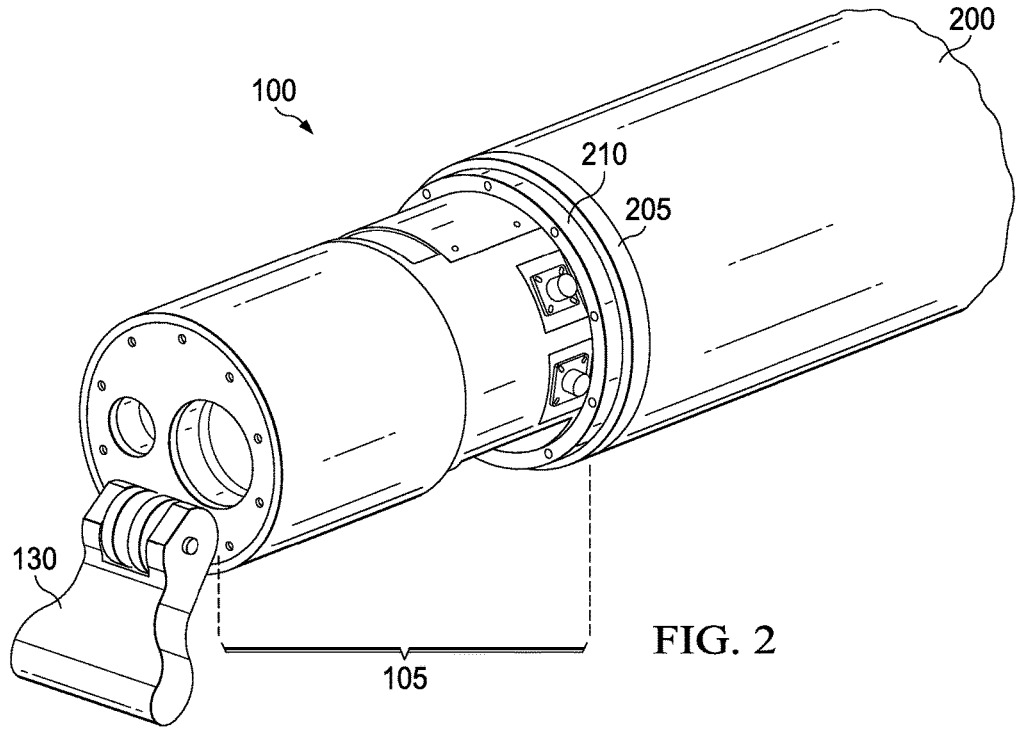
Figure 3:
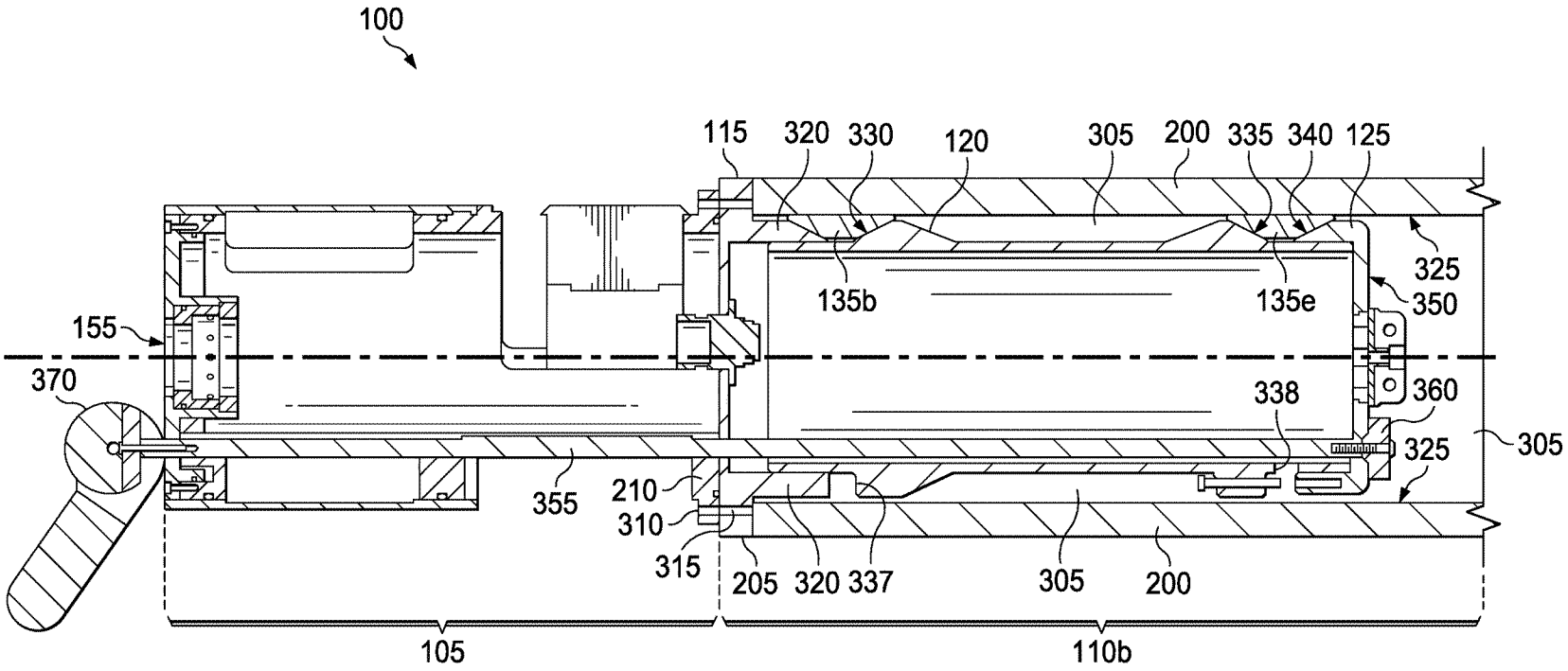

FIGS. 1 through 3 illustrate an example boresight insert 100 according to this disclosure. Although certain details will be provided with reference to the components of the boresight insert 100, it should be understood that other embodiments may include more, less, or different components.

The boresight insert 100 represents a device used to calibrate the aiming system of a weapon. The boresight insert 100 fits inside the bore of the weapon's barrel and identifies a path from the barrel to an impact point for a projectile. This enables a user to adjust an aiming system (such as a scope or other type of sight) of the weapon to identify the same impact point. In some embodiments, the boresight insert 100 represents a one-piece assembly that encases all optical, electrical power, and mechanical equipment inside one cylindrical shell (such as an aluminum shell).

In this example, the boresight insert 100 and its components are generally cylindrical in shape to easily slide through an opening at the front end of a weapon barrel and fit within the bore of the barrel. Here, the boresight insert 100 includes an optics section 105 mounted to a mechanical section 110 (which includes a front portion 110*a* and a rear portion 110*b*). The boresight insert 100 allows a user to align the optics section 105 with the muzzle of the weapon barrel simply by engaging the rear portion 110*b* of the mechanical section 110 within the bore of the weapon. In particular embodiments, the boresight insert 100 could be relatively lightweight compared to conventional systems, such as approximately 15-20 pounds, allowing the boresight insert 100 to be carried or handled by a single person.

The optics section 105 houses one or more sources (such as one or more laser light sources) that generate and emit light indicating a point at which the weapon muzzle is aimed. A beam of light emitted from the source(s) creates a target dot on an object. For example, the source(s) can emit light through one or more orifices 155 in a front face of the optics section 105. In some embodiments, the boresight insert 100 is self-powered without using an external power source, and the optics section 105 generates the light using a power source internal to the boresight insert 100.

The rear portion 110*b* of the mechanical section 110 engages with the bore of the weapon (such as via compression), while the front portion 110*a* of the mechanical section 110 controls the engagement with the bore of the weapon. The rear portion 110*b* of the mechanical section 110 may be referred to as a mechanical coupler since it actually engages the barrel of a weapon to secure the boresight insert in place. In some embodiments, the rear portion 110*b* of the mechanical section 110 engages with the bore of the weapon at six points of contact to restrict the boresight from moving according to six degrees of freedom (6 DoF). The six degrees of freedom can represent translational 6 DoF (forward, backward, up, down, left, and right) or rotational 6 DoF (pitch, yaw, and roll).

The mechanical section 110 is configured to attach to the optics section 105. For example, the mechanical section 110 could be physically separate from the optics section 105 until the optics section 105 is bolted or otherwise connected to the mechanical section 110. The process of attaching the optics section 105 to the mechanical section 110 can be performed during manufacture of the boresight insert 100 or in the field before use.

During use, a user slidably inserts the rear portion 110*b* of the mechanical section 110 into the muzzle of a weapon, causing the boresight insert 100 to slide inside the bore of the weapon barrel. The optics section 105 can remain in front of the muzzle and outside of the barrel since the boresight insert 100 includes a portion that controls the depth of insertion into the bore, which is described more fully below. Additionally, the user may orient the top of the boresight insert 100 with the top of the bore using a clocking feature of the boresight insert 100. For instance, the user can rotate or spin the boresight insert 100 until the user feels the clocking features mate. The clocking feature is also described more fully below.

The user can use his or her hand to actuate an engagement device that transitions the rear portion 110*b* of the mechanical section 110 from a disengaged position to an engaged position. While engaged with the bore of the weapon barrel, the rear portion 110*b* of the mechanical section 110 maintains a rigid constraint of the degrees of freedom of movement of the boresight insert 100. This attaches the boresight insert 100 to the weapon barrel in a fixed position within the bore.

The user can also use his or her hand to actuate the engagement device that transitions the rear portion 110*b* of the mechanical section 110 from the engaged position to the disengaged position. While disengaged, the annular clearance space between the rear portion 110*b* of the mechanical section 110 and the interior surface of the barrel enables the mechanical section 110 to be easily removed from the bore. This detaches the boresight insert 100 from the weapon barrel so that the boresight insert 100 is free to move within the clearance space between the interior surface of the barrel and the outer surface of the boresight insert 100 or to slide into or out of the bore longitudinally.

In this example, the rear portion 110*b* of the mechanical section 110 includes a front shell 115, a center shell 120, a rear shell 125, multiple locking wedges 135*a*-135*f*, and multiple tension springs 140. Note that locking wedges 135*c* and 135*f* are hidden from view in FIG. 1. The front portion 110*a* of the mechanical section 110 includes a cam handle 130.

The front shell 115, center shell 120, and rear shell 125 are generally circular and are aligned with each other such that a longitudinal center axis of the front shell 115 is collinear with a longitudinal center axis of the center and rear shells 120-125. That is, all of the shells 115-125 share a common center longitudinal axis, which is the center line through the longitudinal center of the mechanical section 110.

The cam handle 130 allows a user to engage and disengage the rear portion 110*b* of the mechanical section 110 within the bore of a weapon barrel. The cam handle 130 includes an arm portion configured such that a person may grasp and exert force on the cam handle 130 to lower or lift the cam handle 130.

The cam handle 130 is contoured to further include a disengage flat surface portion 145, an engage flat surface portion 150, and a round rocker portion that separates the flat surface portions 145-150. When the cam handle 130 is up, the mechanical section 110 is in the disengaged position, and the disengage flat surface portion 145 is in physical contact with and flush to the front face of the optics section 105. When the user pushes down on the cam handle 130, the mechanical section 110 is in the engaged position, and the engage flat surface portion 150 is in physical contact with and flush to the front face of the optics section 105. In FIG. 1, the mechanical section 110 is in the engaged position.

FIG. 2 illustrates the boresight insert 100 inserted into the bore of a weapon barrel 200. The weapon barrel 200 is a generally cylindrical hollow tube composed from a ridged material such as metal, carbon fiber, or polymer. The rear shell 125 and center shell 120 of the mechanical section 110 and a portion of the front shell 115 are hidden within the bore of the barrel 200, while the optics section 105 and a front portion 205 of the front shell 115 are visible outside the barrel 200. The circumferences of the rear shell 125, the center shell 120, and the hidden portion of the front shell 115 are smaller than the inner circumference of the barrel 200. Accordingly, when the mechanical section 110 is disengaged, the boresight insert 100 easily slides within the bore of the barrel 200. The front portion 205 of the front shell 115 has a circumference larger than the inner circumference of the barrel 200, limiting the depth of insertion of the boresight insert 100 to a predetermined distance. In some embodiments, the circumference of a back portion 210 of the optics section 105 is larger than the inner circumference of the barrel 200, preventing the optics section 105 from being inserted into the bore.

FIG. 3 illustrates a cross-sectional view of the boresight insert 100 inserted into a bore 305 of the weapon barrel 200. Note that one or more light sources in the optics section 105 have been removed for clarity. As shown here, the back portion 210 of the optics section 105 includes threaded bolt holes 310 configured to align with threaded bolt holes 315 within the front portion 205 of the front shell 115. The threaded bolt holes 310-315 are configured to receive threaded bolts to rigidly connect the optics section 105 to the mechanical section 110.

The rear portion 110*b* of the mechanical section 110 is configured to be inserted into the muzzle or front end of the bore 305. An engagement device enables a user to easily control the engagement or disengagement of the rear portion 110*b* of the mechanical section 110 with the bore 305 of the barrel 200.

As shown in FIG. 3, the front portion 205 of the front shell 115 is in physical contact with the front face of the barrel 200, while a longitudinal portion 320 of the front shell 115 is disposed within the bore 305. The longitudinal portion 320 of the front shell 115 also has an angled surface that contacts an angled surface of the locking wedge 135*b*. Although not shown here, the longitudinal portion 320 of the front shell 115 further has angled surfaces that contact angled surfaces of the locking wedges 135*a* and 135*c*.

The cross-sectional shape of the center shell 120 varies based on proximity to the locking wedges. For example, the center shell 120 could have angled surfaces 330-335 that engage angled surfaces of the locking wedges 135*a*-135*f* in some locations and perpendicular surfaces 337-338 in other locations between adjacent locking wedges. The perpendicular surfaces help to prevent the locking wedges 135*a*-135*f* from moving annularly around the mechanical section 110. The rear shell 125 can include angled surfaces 340 that engage angled surfaces of the locking wedges 135*d*-135*f*.

The shells 115-125 therefore collectively form separate slots for receiving the locking wedges. The slots allow each locking wedge to move radially inward and outward with reference to the center axis of the boresight insert 100. The slots also limit axial movement of the locking wedges to the boundaries of the slots and prevent annular movement of the locking wedges.

For simplicity, features of the locking wedges 135*b* and 135*e* will be described, although the same description can apply to all locking wedges. The locking wedge 135*b* includes a front angled surface that contacts the angled surface of the longitudinal portion 320 of the front shell 115. The locking wedge 135*b* also includes a rear angled surface that contacts the angled surface 330 of the center shell 120. An outer axial surface of the locking wedge 135*b* can contact a surface 325 of the bore 305 when the boresight insert 100 is placed in the engaged position. Similarly, the locking wedge 135*e* includes a front angled surface that contacts the angled surface 335 of the longitudinal portion 320 of the front shell 115. The locking wedge 135*e* also includes a rear angled surface that contacts the angled surface 340 of the rear shell 125. An outer axial surface of the locking wedge 135*e* can contact the surface 325 of the bore 305 when the boresight insert 100 is placed in the engaged position. The same operations could be performed by other locking wedges. Note that the locking wedges could have any suitable angular distribution around the boresight insert 100, such as a 120° separation.

The center shell 120 enables the locking wedges 135*a*-135*f* to maintain contact with the angled surfaces of the front and rear shells 115, 125. The contours of the outer surface of the center shell 120 also produce forces against the locking wedges 135*a*-135*f* that hold the front set of locking wedges 135*a*-135*c* between the front and center shells 115, 120 and that hold the rear set of locking wedges 135*d*-135*f* between the center and rear shells 120, 125. The center shell 120 also forms an open-ended hollow tube between the front shell 115 and the rear shell 125 and extends the majority of the length of the rear portion 110*b* of the mechanical section 110. The front shell 115 and the rear shell 125 provide barriers that prevent the center shell 120 from sliding forward or backward out of the mechanical section 110.

The rear shell 125 is attached to an engagement device, enabling the engagement device to compress the length of the rear portion 110*b* of the mechanical section 110. In this example, the rear shell 125 includes an opening through which a cam rod 355 is fitted in order to connect to a mounting bracket 360 on a rear surface 350 of the shell 125. The cam handle 130 is attached to the rear shell 125 by the cam rod 355 such that rotating the cam handle 130 to the engaged position pulls the rear shell 125 toward the front shell 115, which remains stationary. This causes the rear shell 125 to press against the locking wedges 135*d*-135*f*. This also causes the rear shell 125 to press against the center shell 120, which then presses against the locking wedges 135*a*-135*c*.

The cam rod 355 holds tension while the cam handle 130 is actuated. For example, the cam rod 355 can represent a tension rod that extends from a rear-facing flat surface of a cam pivot 370 to the back surface 350 of the rear shell 125. The cam rod 355 can be rigidly attached to the rear shell 125 and to the cam pivot 370 in any suitable manner, such as by using threaded bolts.

Using this structure, the rear portion 110*b* of the mechanical section 110 has a compressed length and the locking wedges 135*a*-135*f* are placed into physical contact with the bore 305 of the weapon barrel 200 when the mechanical section 110 is in the engaged position. When the mechanical section 110 is in the disengaged position, the rear portion 110*b* of the mechanical section 110 has a longer length, and the locking wedges 135*a*-135*f* are not placed into physical contact with the bore 305 of the weapon barrel 200. Note, however, that the locking wedges 135*a*-135*f* could alternatively contact the barrel 200 when disengaged but not apply significant force against the barrel 200.

Although FIGS. 1 through 3 illustrate one example of a boresight insert 100, various changes may be made to FIGS. 1 through 3. For example, the form and number of each component shown in FIGS. 1 through 3 are for illustration only. As a particular example, the boresight insert 100 could include more or fewer locking wedges.

Figure 4:
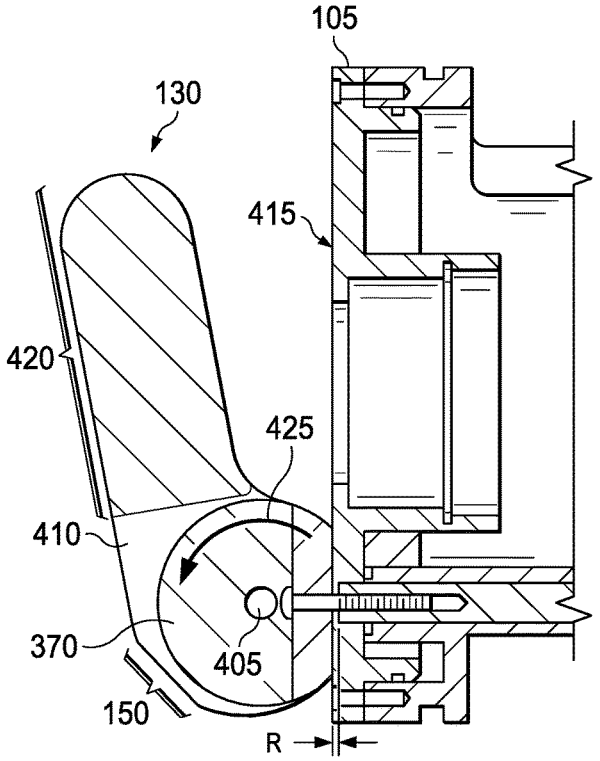
FIGS. 4 and 5 illustrate example operation of a cam handle in the boresight insert according to this disclosure.
Figure 5:
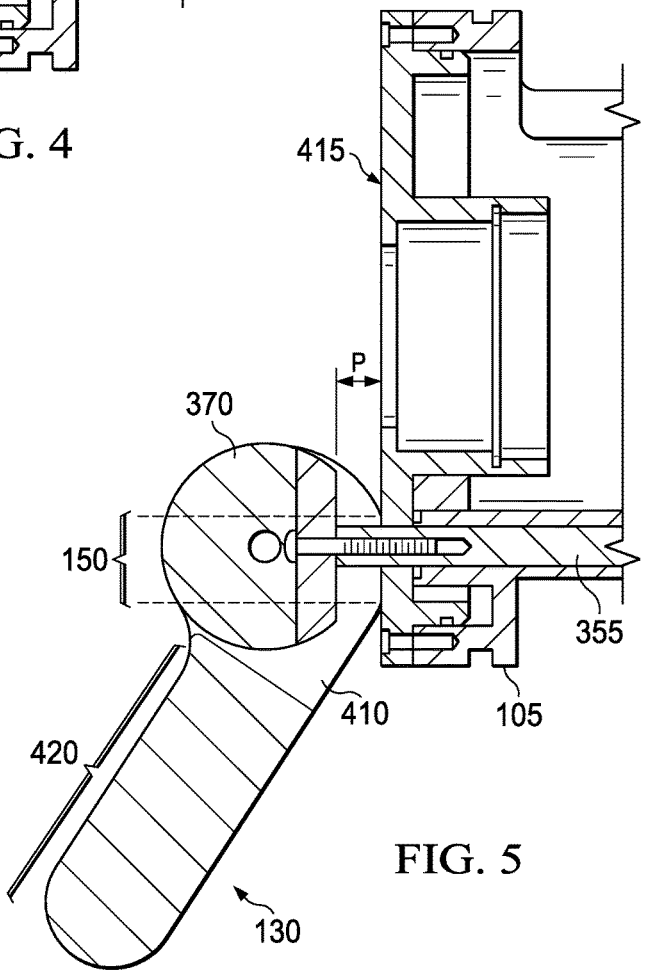

FIGS. 4 and 5 illustrate example operation of a cam handle 130 in the boresight insert 100 according to this disclosure. In FIG. 4, the cam handle 130 is in the disengaged position. In FIG. 5, the cam handle 130 is in the engaged position.

As shown here, the cam handle 130 includes the cam pivot 370 and a pin 405. The cam handle 130 also includes an outer member having a central portion 410 that contacts a front surface 415 of the optics section 105 and an arm portion 420 that extends from the central portion 410. The front surface 415 of the optics section 105 exerts a normal force 425 (perpendicular to the plane of contact) on the outer member of the cam handle 130. The outer member is pivotally connected to the cam pivot 370 by the pin 405, such as a shear pin. The pin 405 therefore functions as an axis of rotation about which the outer member and cam pivot 370 rotate.

The disengage flat surface portion 145 is hidden from view by the cam pivot 370 here. The flat surface contour of the disengage flat surface portion 145 prevents the cam handle 130 from releasing from the disengaged position without user intervention. The engage flat surface portion 150 is disposed away from the front surface 415 of the optics section 105 in FIG. 4. Rotating the arm portion 420 of the cam handle 130 downward causes the central portion 410 of the cam handle 130 to rotate, pulling the cam rod 355 forward in FIG. 5. In FIG. 4, the front of the cam rod 355 is recessed from the front surface 415 of the optics section 105 by a distance R. In FIG. 5, the cam rod 355 has moved forward, and the front of the cam rod 355 protrudes beyond the front face 415 of the optics section 105 by a distance P. The amount of compression between the front and rear shells 115, 125 can be expressed by the difference between P and R. In some embodiments, the cam handle 130 provides 0.4 inches of compression between the front and rear shells 115, 125.

Although FIGS. 4 and 5 illustrate example operation of a cam handle in the boresight insert 100, various changes may be made to FIGS. 4 and 5. For example, other mechanisms could be used to compress the rear portion 110*b* of the mechanical section 110.

Figure 6:
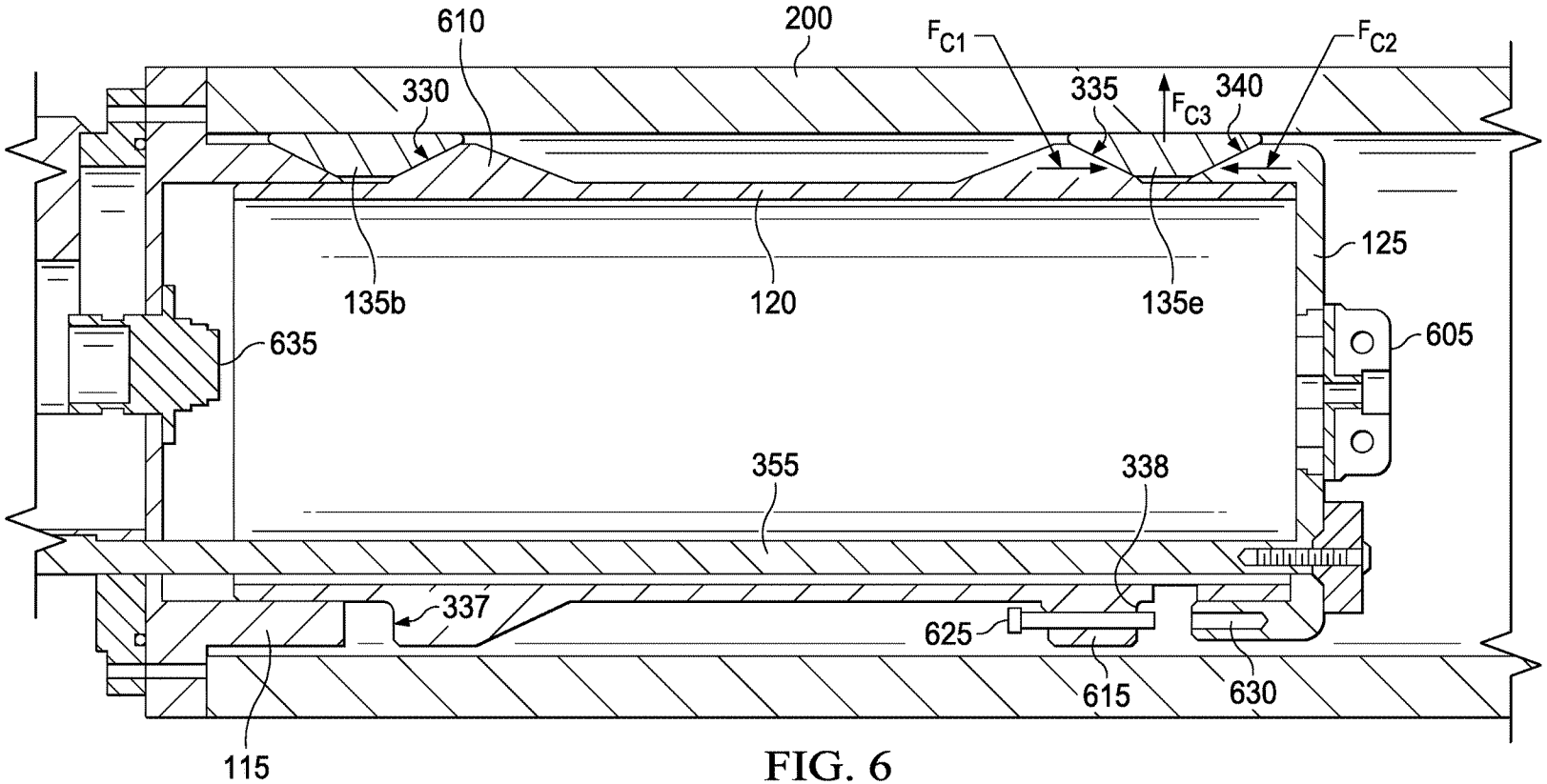
FIGS. 6 through 9 illustrate an example rear portion of a mechanical section in the boresight insert according to this disclosure.

FIGS. 6 through 9 illustrate an example rear portion 110*b* of the mechanical section 110 in the boresight insert 100 according to this disclosure. As shown in FIG. 6, when the mechanical section 110 is engaged using the cam rod 355, the cam rod 355 causes the angled surface 340 of the rear shell 125 and the angled surface 335 of the center shell 120 to exert compressive forces $F_{C1}$ and $F_{C2}$ against the locking wedge 135*e* in opposing directions, driving the locking wedge 135*e* radially outward into compressive contact with the barrel 200. The compressive force $F_{C3}$ that the locking wedge 135*e* exerts on the barrel 200 prevents easy removal of the boresight insert 100 from the barrel 200. As described below with reference to FIG. 9, a tension spring 140 also applies tension to the locking wedge 135*e*.

The center shell 120 here includes radial protrusions 610-615 near the front and back to form slots and boundaries for the locking wedge 135*a*-135*f*. The front protrusions 610 include the perpendicular surfaces 337 that block the locking wedges 135*a*-135*c* from moving annularly, and the back protrusions 615 include the perpendicular surfaces 338 that block the locking wedges 135*d*-135*f* from moving annularly. Note that the protrusions 610-615 are different here, although they alternatively have the same shape.

The protrusions 615 include openings configured to receive bolts 625 or other mechanisms for mechanically coupling the center shell 120 and the rear shell 125. The bolts 625 here include non-threaded portions and threaded portions configured to twist into threaded bolt holes 630 in the rear shell 125. The non-threaded portions of the bolts 625 permit a small amount of movement of the center shell 120 independent of the rear shell 125. Moreover, the depth that the threaded portions of the bolts 625 are installed into the bolt holes 630 of the rear shell 125 controls or otherwise sets the maximum amount of separation allowed between the center and rear shells 120-125. In some scenarios, the insertion depth of the bolts 625 into the bolt holes 630 can also limit the amount of compression or limit the length of the rear portion 110*b* of the mechanical section 110.

As noted above, an internal power source could be used to supply power to the optics section 605. In some embodiments, the rear portion 110*b* of the mechanical section 110 houses a power source, such as a battery pack 605. An end portion of the battery pack 605 extends from the back surface of the rear shell 125 here. Power can be provided to the optics section 105 using wires that pass from the mechanical section 110 to the optics section 105 through a bulkhead 635.

Figure 7:
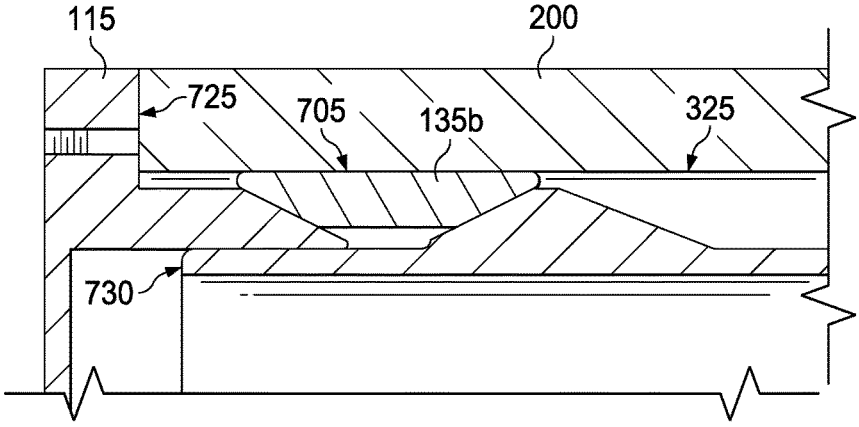
Figure 8:
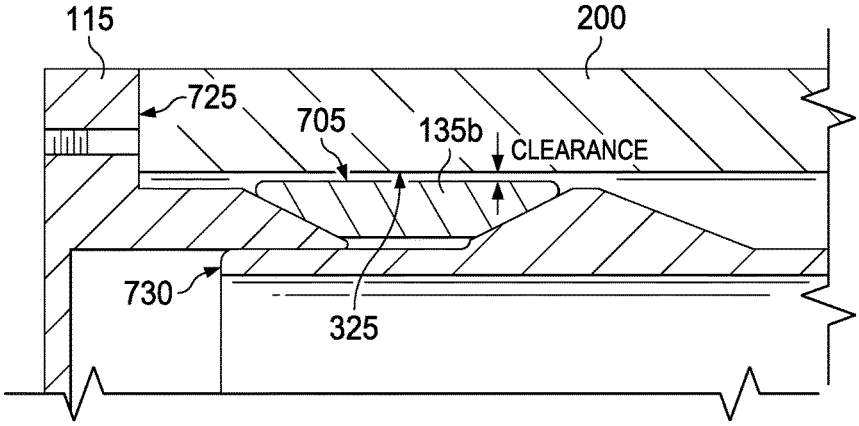

FIGS. 7 and 8 illustrate operation of a locking wedge in the rear portion 110*b* of the mechanical section 110. For simplicity, FIGS. 7 and 8 are described with reference to the locking wedge 135*c*, although similar descriptions can apply to the other locking wedges.

As shown in FIG. 7, an outer axial surface 705 of the locking wedge 135*c* is in contact with the surface 325 of the barrel 200, indicating that the mechanical section 110 is engaged with the barrel 200. In the disengaged position as shown in FIG. 8, the locking wedge 135*c* is not in contact with the barrel 200.

A clearance space is disposed between the outer axial surface 705 of the locking wedge 135*c* and the surface 325 of the bore 305 in FIG. 8. This allows for easy movement of the boresight insert 100 within the barrel 200. As described below, the tension springs 140 can be used to help keep the locking wedge 135*c* in the position shown in FIG. 8 until the boresight insert 100 is engaged.

FIGS. 7 and 8 also show a surface 725 of the front shell 115, which contacts the barrel 200. As described below, the surface 725 of the front shell 115 and the barrel 200 could support a clocking feature.

Figure 9:
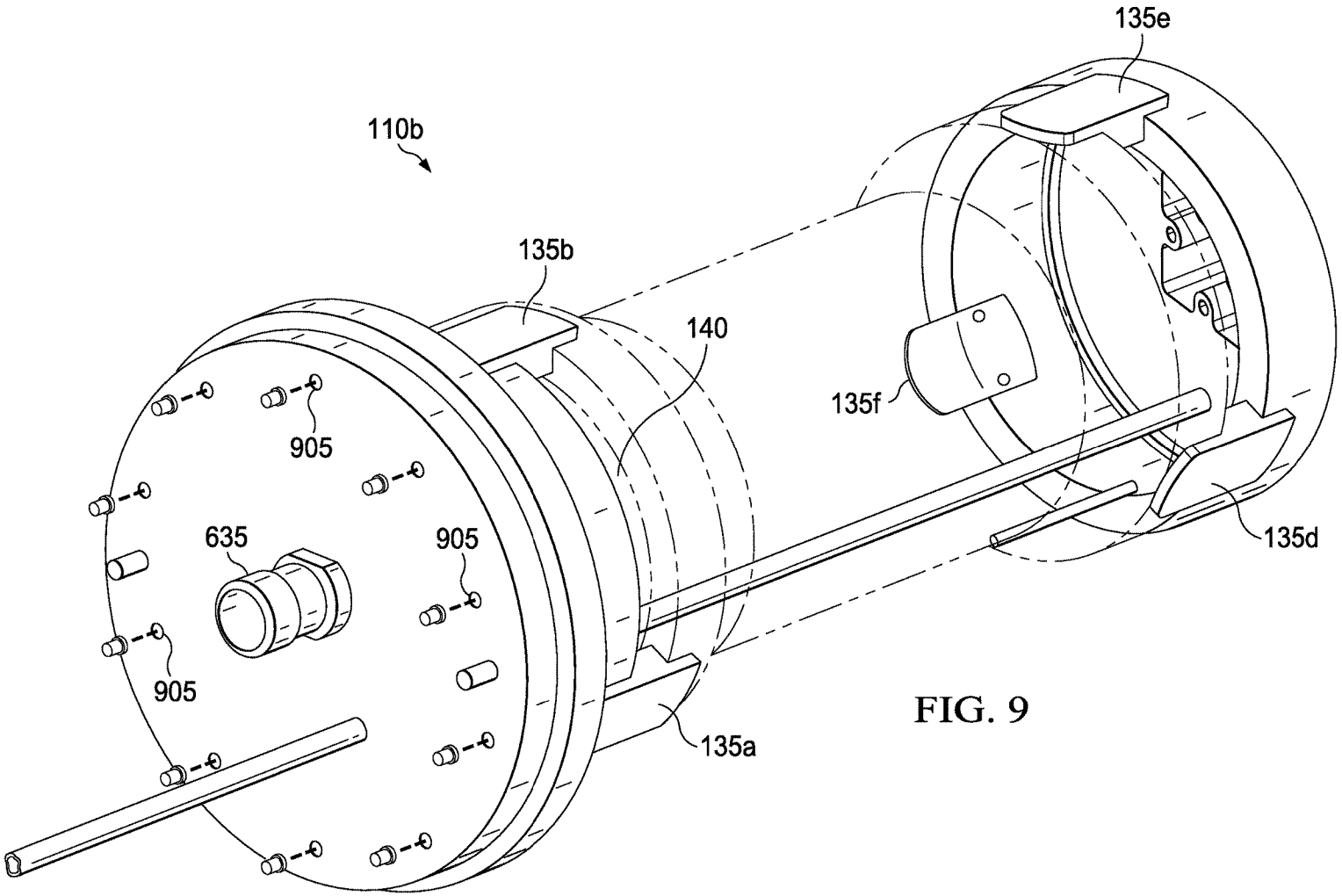

FIG. 9 illustrates another view of the rear portion 110*b* of the mechanical section 110 in the boresight insert 100. Here, the center shell 120 is shown as translucent or transparent to reveal various locking wedges 135*a*-135*f* on different sides of the mechanical section 110. The number of locking wedges here can define the number of points of contact between the mechanical section 110 and the barrel 200. In this example, there are six points of contact, although other numbers could also be used. In some embodiments, the locking wedges 135*a*-1353*c* are separated from the locking wedges 135*d*-135*f* by around 7.5 inches, although other distances could be used based on various factors (such as the length of the rear portion 110*b*).

When engaged, the compressive forces and friction between the locking wedges and the barrel 200 prevent the rear portion 110*b* of the mechanical section 110 from rolling within the bore 305 and from moving into or out of the bore 305. Note that while two sets of three locking wedges with an angular spacing of 120° are shown here, any number of locking wedges and any angular spacing could be used (such as two wedges at a 180° spacing or four wedges at a 90° spacing). However, it may be desirable to include at least two sets of locking wedges (such as one at the front and one at the back of the rear portion 110*b*) to keep the boresight insert 100 properly aligned with the barrel 200.

As shown in FIG. 9, a tension spring 140 can be coupled to multiple locking wedges. In this example, the tension spring 140 is coupled to neighboring locking wedges 135*a*-135*b*, although other tension springs could similarly couple other neighboring locking wedges at front or back of the rear portion 110*b*. The tension spring 140 continuously provides tension on the neighboring pair of locking wedges 135*a*-135*b*, thereby pulling the locking wedges 135*a*-135*b* toward each other. This helps to maintain the locking wedges 135*a*-135*b* in the lowered position shown in FIG. 8 unless the mechanical section 110 is engaged by a user. When engaged, the angled surfaces of the shells 120-125 push against the locking wedges, overcoming the force provided by the tension springs 140 and moving the locking wedges 135*a*-135*b* radially outward into the position shown in FIG. 7. The tension spring 140 can be arced corresponding to the curvature of the outer surface of the center shell 120.

The rear portion 110*b* of the mechanical section 110 also includes multiple threaded bolt holes 905, which can be used to couple the rear portion 110*b* of the mechanical section 110 to the optics section 105. In some embodiments, the same rear portion 110*b* could be coupled to various types of optics sections 105.

Although FIGS. 6 through 9 illustrate one example of the rear portion 110*b* of a mechanical section 110 in the boresight insert 100, various changes may be made to FIGS. 6 through 9. For example, the number and positioning of the locking wedges could vary.

Figure 10:
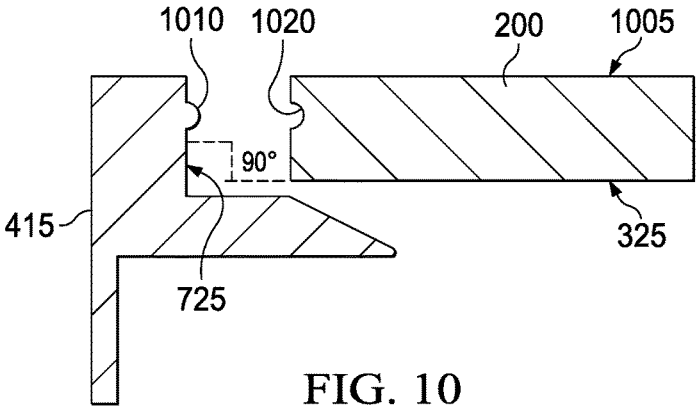
FIG. 10 illustrates an example clocking feature of the boresight insert of FIG. 1 according to this disclosure.

FIG. 10 illustrates an example clocking feature of the boresight insert 100 of FIG. 1 according to this disclosure. As shown in FIG. 10, the surface 725 of the front shell 115 extends from the surface 325 of the bore 325, which is the interior surface of the barrel 200, radially outward toward an outer surface 1005 of the barrel 200. This prevents the optics section 105 from entering the bore 305.

Moreover, in this example, the surface 725 includes a clocking feature 1010 that corresponds to a clocking feature 1020 on the front face of the weapon barrel 200. When the two clocking features 1010-1020 meet, the boresight insert 100 is oriented properly with the weapon. Here, the front surface of the barrel 200 includes an indentation forming a recess, while the surface 725 of the front shell 115 includes a corresponding protrusion that can fit within the recess.

Although FIG. 10 illustrates one example of a clocking feature of the boresight insert 100, various changes may be made to FIG. 10. For example, any other suitable mechanism could be used to ensure proper orientation of the boresight insert 100 in the barrel 200, assuming such proper orientation is even necessary.

It may be advantageous to set forth definitions of certain words and phrases used throughout this patent document. The terms "include" and "comprise," as well as derivatives thereof, mean inclusion without limitation. The term "or" is inclusive, meaning and/or. The phrase "associated with," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, have a relationship to or with, or the like. The phrase "at least one of," when used with a list of items, means that different combinations of one or more of the listed items may be used, and only one item in the list may be needed. For example, "at least one of: A, B, and C" includes any of the following combinations: A, B, C, A and B, A and C, B and C, and A and B and C.

While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure, as defined by the following claims.

To aid in the interpretation of the claims appended hereto, none of the appended claims or claim elements invoke 35 U.S.C. §112(f) as it exists on the date of filing hereof, unless the words "means for" or "step for" are explicitly used in the particular claim.

What is claimed is:

1. A system comprising:

a boresight insert configured to be partially inserted into a barrel of a weapon, the boresight insert comprising:

an optics section configured to generate light that identifies an impact point for a projectile from the weapon;

a mechanical section coupled to the optics section, the mechanical section configured to engage an inner surface of the barrel to secure the boresight insert in place and to disengage the inner surface of the barrel to allow insertion and removal of the boresight insert, wherein the mechanical section comprises first, second, and third shells; and multiple wedges positioned between angled surfaces of the shells;

wherein:

the first shell is configured to couple to the optics section and includes a flange having an outer diameter larger than a diameter of the inner surface of the barrel;

the second shell is disposed between the first shell and the third shell; and the third shell is configured to be moved towards the first shell, while the first shell remains stationary, in order to cause the mechanical section to engage the inner surface of the barrel.

2. The system of claim 1, wherein the mechanical section further comprises:

a cam rod passing through the first and second shells and connected to the third shell; and a cam handle configured to (i) pull on the cam rod to move the third shell closer to the first shell and (ii) push on the cam rod to move the third shell farther from the first shell.

3. The system of claim 1, wherein:

the second shell is coupled to the third shell using multiple bolts, each bolt comprising an unthreaded portion; and the unthreaded portions of the bolts permit the second shell to move independently of the third shell by a specified amount.

4. The system of claim 1, wherein the boresight insert comprises a clocking feature configured to mate with a clocking feature on the barrel to orient the boresight insert within the barrel.

5. The system of claim 1, wherein the flange limits depth of insertion of the boresight insert to a predetermined distance beyond a muzzle of the weapon, and wherein the flange is configured to mechanically fasten to the optics section.

6. A system comprising:

a boresight insert configured to be partially inserted into a barrel of a weapon, the boresight insert comprising:

an optics section configured to generate light that identifies an impact point for a projectile from the weapon; and a mechanical section coupled to the optics section, the mechanical section configured to engage an inner surface of the barrel to secure the boresight insert in place and to disengage the inner surface of the barrel to allow insertion and removal of the boresight insert, wherein:

the mechanical section comprises first, second, and third shells and multiple wedges positioned between angled surfaces of the shells;

the first shell is configured to couple to the optics section;

the second shell is disposed between the first shell and the third shell;

the third shell is configured to be moved towards the first shell in order to cause the mechanical section to engage the inner surface of the barrel;

the wedges are configured to move outward when the third shell is moved towards the first shell; and the wedges are configured to move inward when the third shell is moved away from the first shell.

7. The system of claim 6, wherein:

the mechanical section further comprises multiple tension springs, each tension spring connected to at least two of the wedges; and the tension springs are configured to pull the wedges inward.

8. The system of claim 6, wherein the wedges comprise multiple sets of wedges located at different positions along a length of the mechanical section, the wedges in each set disposed evenly around a central axis of the boresight insert.

9. The system of claim 6, wherein at least one of the shells is configured to prevent the wedges from moving circumferentially around a central axis of the boresight insert.

10. An apparatus comprising:

a mechanical coupler configured to be inserted into a barrel of a weapon, the mechanical coupler also configured to be coupled to optics that generate light to identify an impact point for a projectile from the weapon, the mechanical coupler further configured to engage an inner surface of the barrel to secure the mechanical coupler in place and to disengage the inner surface of the barrel to allow insertion and removal of the mechanical coupler;

wherein the mechanical coupler comprises:

first, second, and third shells, the first shell configured to be coupled to the optics, the second shell disposed between the first shell and the third shell, the third shell configured to be moved towards the first shell in order to cause the mechanical coupler to engage the inner surface of the barrel; and multiple wedges positioned between angled surfaces of the shells.

11. The apparatus of claim 10, wherein:

the wedges are configured to move outward when the third shell is moved towards the first shell; and the wedges are configured to move inward when the third shell is moved away from the first shell.

12. The apparatus of claim 11, wherein:

the mechanical coupler further comprises multiple tension springs, each tension spring connected to at least two of the wedges; and the tension springs are configured to pull the wedges inward.

13. The apparatus of claim 10, wherein the wedges comprise multiple sets of wedges located at different positions along a length of the mechanical coupler, each set of wedges disposed even around a central axis of the boresight insert.

14. The apparatus of claim 10, wherein at least one of the shells is configured to prevent the wedges from moving circumferentially around a central axis of the boresight insert.

15. The apparatus of claim 10, wherein the mechanical coupler further comprises a cam rod passing through the first and second shells and connected to the third shell; and a cam handle pivotally coupled to the cam rod, the cam handle configured to pull on the cam rod to move the third shell closer to the first shell and to push on the cam rod to move the third shell farther from the first shell.

16. The apparatus of claim 10, wherein:

the second shell is coupled to the third shell using multiple bolts, each bolt comprising an unthreaded portion; and the unthreaded portions of the bolts permit the second shell to move independently of the third shell by a specified amount.

17. The apparatus of claim 10, wherein the first plate comprises a clocking feature configured to mate with a clocking feature on the barrel to orient the boresight insert within the barrel.

18. A method comprising:

partially inserting a boresight insert into a barrel of a weapon;

engaging the boresight insert to secure the boresight insert in the barrel;

generating light using optics of the boresight insert to identify an impact point for a projectile from the weapon; and disengaging the boresight insert to remove the boresight insert from the barrel;

wherein the boresight insert comprises:

first, second, and third shells, the first shell configured to be coupled to the optics, the second shell disposed between the first shell and the third shell, the third shell configured to be moved towards the first shell in order to cause the boresight insert to engage the inner surface of the barrel; and multiple wedges positioned between angled surfaces of the shells.

19. The method of claim 18, wherein:

the wedges move outward when the third shell is moved towards the first shell; and the wedges move inward when the third shell is moved away from the first shell.

20. The method of claim 18, further comprising:

mating a clocking feature on the first plate with a clocking feature on the barrel to orient the boresight insert within the barrel.

* * * * *